US006484454B1

(12) United States Patent
Everhart

(10) Patent No.: US 6,484,454 B1
(45) Date of Patent: Nov. 26, 2002

(54) MULTI-CIRCULAR MODULAR RESIDENCE

(76) Inventor: Richard Everhart, 2924 Cockerham St., Winston-Salem, NC (US) 27127

( * ) Notice: Subject to any disclaimer, the term of this patent is extended or adjusted under 35 U.S.C. 154(b) by 0 days.

(21) Appl. No.: 09/492,664

(22) Filed: Jan. 27, 2000

(51) Int. Cl.[7] ..... E04H 1/00

(52) U.S. Cl. ..... 52/79.4; 52/79.8; 52/169.6; 52/185; D25/4

(58) Field of Search ..... 52/236.2, 79.4, 52/185, 73, 79.7, 79.8, 169.6, 187; D25/4, 31

(56) References Cited

U.S. PATENT DOCUMENTS 915,026 A * 3/1909 Guasavino ..... 52/236.2
3,164,111 A * 1/1965 Lanni ..... 52/236.2
4,103,446 A * 8/1978 Nagase ..... 52/73
4,441,285 A * 4/1984 Fridolfsson ..... 52/73

FOREIGN PATENT DOCUMENTS

GB 25895 * 11/1913 ..... 52/236.2
IT 554831 * 1/1957 ..... 52/236.2

* cited by examiner

*Primary Examiner*—Michael Safavi

(57) ABSTRACT

A residential complex formed of circular modules, the central part of the residence formed by the principal circular module and the bedrooms and other remote living areas formed by secondary circular modules. The modules are interconnected by upper and lower passageways, and the secondary modules may be angularly positioned with respect to the principal module to accommodate elevations and other surface characteristics of the residence site. A circular stairway along the interior peripheral wall connects the upper and lower floors of the principal module, and circular domes with circular centered skylights, circular chimneys and an arcuate cantilevered structure promote the circular theme.

17 Claims, 12 Drawing Sheets

MULTI-CIRCULAR MODULAR RESIDENCE

FIELD AND BACKGROUND OF THE INVENTION

1. Field of the Invention

The present invention is a residential structure and, more particularly, a multi-circular module residence having a principal circular module and a plurality of secondary circular modules.

2. Background of the Invention

Residential construction has conventionally been confined to square or rectangularly configured buildings and square or rectangular rooms within the buildings, a practice that usually provides the most flexibility in furnishing rooms to utilize all wall space. The building styles of such conventional structure have ranged from expanded single level ranch style dwellings to multi-storied high ceiling dwellings that are more popular today. At an earlier time, modern style home building utilized curved corners and arches in many areas, but still utilized basic square or rectangularly shaped rooms for most of the interiors. While conventional building practices still remain popular and offer and endless variety of design and configuration options, there has been an interest in deviating from such general practices and developing a novel, unique and multi-functional dwelling utilizing a consistent array of geometric designs as a theme for the residence. It is to this interesting and flexible concept that the present invention is directed.

OBJECTIVES AND SUMMARY OF THE INVENTION

The principal objective of the present invention is to provide a residence utilizing a series of circular modules as a central theme of the design.

Another objective of the present invention is to provide a residence of the type described that has distinctly separated circular modules of different sizes connected by passageways.

Yet another objective of the present invention is to provide a residence of the type described wherein the secondary circular modules may be angularly positioned with respect to the principal circular module to accommodate the elevational and other distinct features of the building site.

Yet still another objective of the present invention is to provide a residence of the type described wherein perimeter wall engaging stairways connect the various levels of the floors of the structure.

Yet still another further objective of the present invention is to provide a residence of the type described which has a cantilevered arcuate structure forming a deck or sunroom consistent in curvature with the curvature of the principal circular modular exterior perimeter wall.

A further objective of the present invention is to provide a residence of the type described wherein each of the circular modules has a circular domed roof and can have a circular domed skylight on that roof.

Yet still another further additional objective of the present invention is to provide a residence of the type described, the circular modules of which may have circular chimneys connecting to their exterior perimeter.

The structure of the present invention is a multi-circular module residence having a principal circular module with interior and exterior perimeter walls that includes a basement and one or more additional floors. Each of the floors has rooms utilizing the interior perimeter wall, and the module has a central area conveniently utilized as a sitting area. An interior perimeter wall engaging stairway connect the floor levels of the principal module. Secondary circular modules are separately positioned from the principal module and are connected to the principal module by ground and first level passageways. The secondary modules conveniently contain bedrooms and baths and usually have a garage at ground level. Cantilevered arcuate structures can be associated with the modules and preferably are consistent in curvature with the curvature of the module exterior perimeter wall.

Thus there has been outlined the more important features of the invention in order that the detailed description that follows may be better understood and in order that the present contribution to the art may be better appreciated. There are, of course, additional features of the invention that will be described hereinafter and which will form the subject matter of the claims appended hereto. In this respect, before explaining several embodiments of the invention in detail, it is to be understood that the invention is not limited in its arrangement of the components set forth in the description and illustrated in the drawings. The invention is capable of other embodiments and of being practiced and carried out in various ways.

It is also to be understood that the phraseology and terminology herein are for the purpose of description and should not be regarded as limiting in any respect. Those skilled in the art will appreciate the concept upon which this disclosure is based and that it may readily be utilized as a basis for designing other structures, methods and systems for carrying out the several purposes of this development. It is also to be understood that the abstract is neither intended to define the invention of the application, which is measured by the claims, nor to limit its scope in any way.

Thus, the enumerated objectives and others identified herein, along with the various features of novelty which characterize the invention, are pointed out with particularity in the claims annexed to and forming a part of this disclosure. For a better understanding of the invention, its operating advantages and the specific objects obtained by its use, reference should be made to the accompanying drawings and descriptive material in which like characters of reference designate like parts throughout the several views.

DETAILED DESCRIPTION OF THE PREFERRED EMBODIMENT

Figure 1:
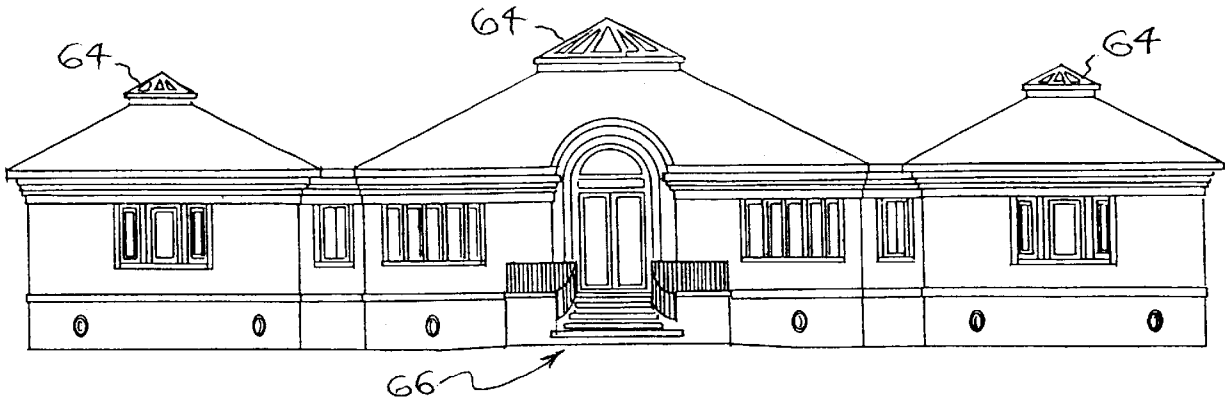
FIG. 1 is a front elevational view of the residential complex comprising the present invention showing the principal circular module and two secondary circular modules.
Figure 2:
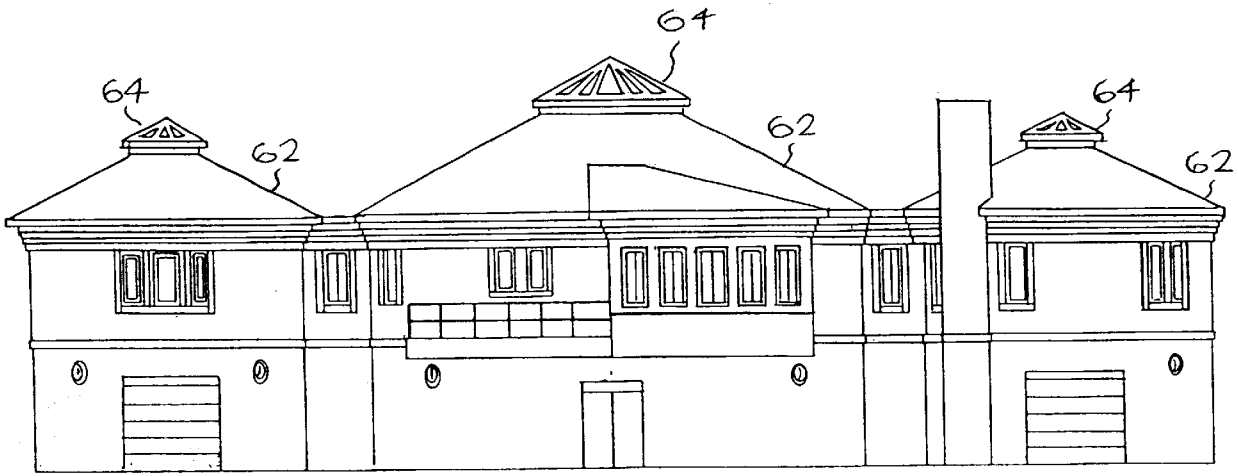
FIG. 2 is a rear elevational view of the complex shown in FIG. 1.
Figure 3:
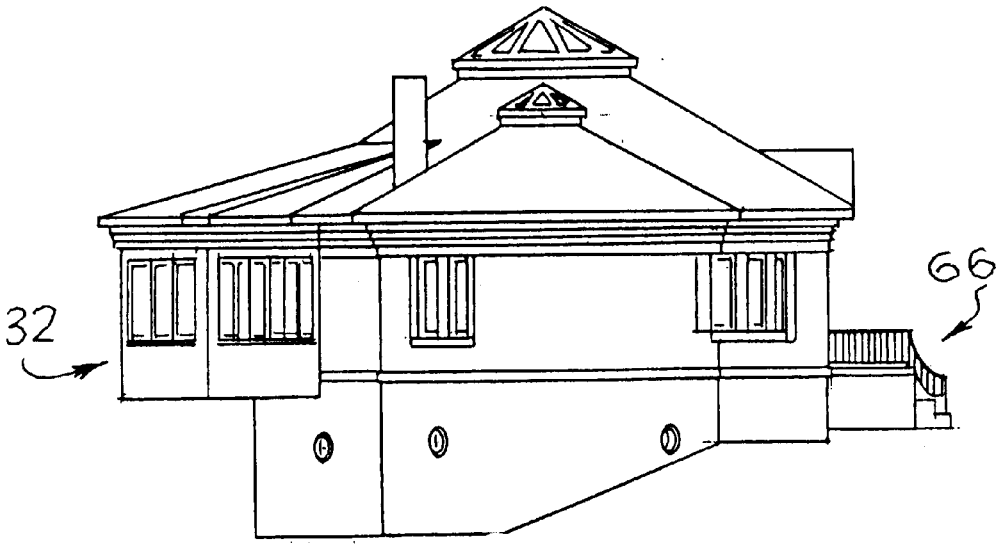
FIG. 3 is a side elevational view of the complex shown in FIGS. 1 and 2.
Figure 4:
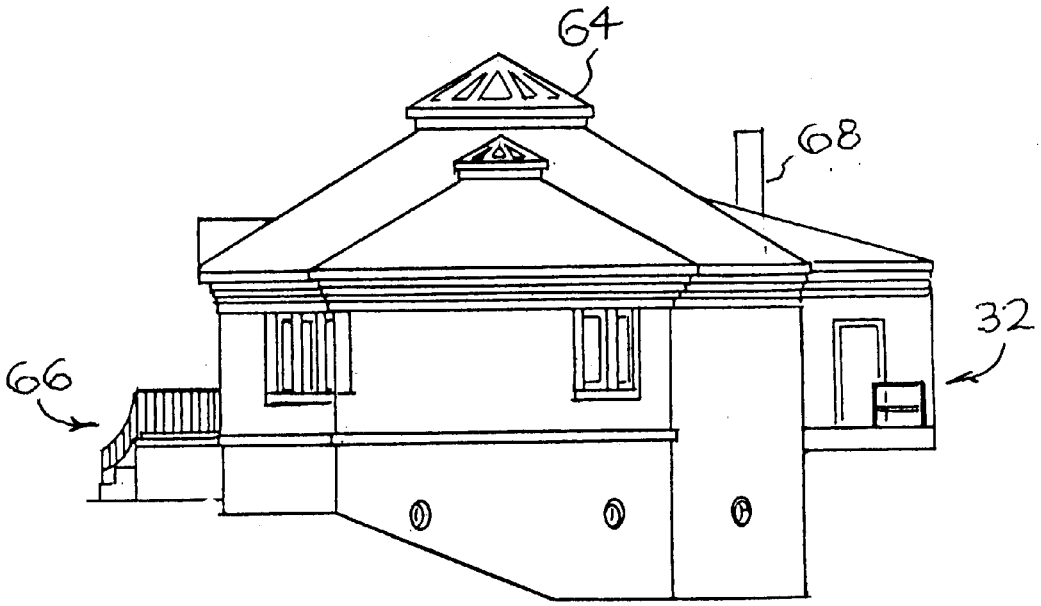
FIG. 4 is a side elevational view of the other side of the complex shown in FIGS. 1 and 2.
Figure 5:
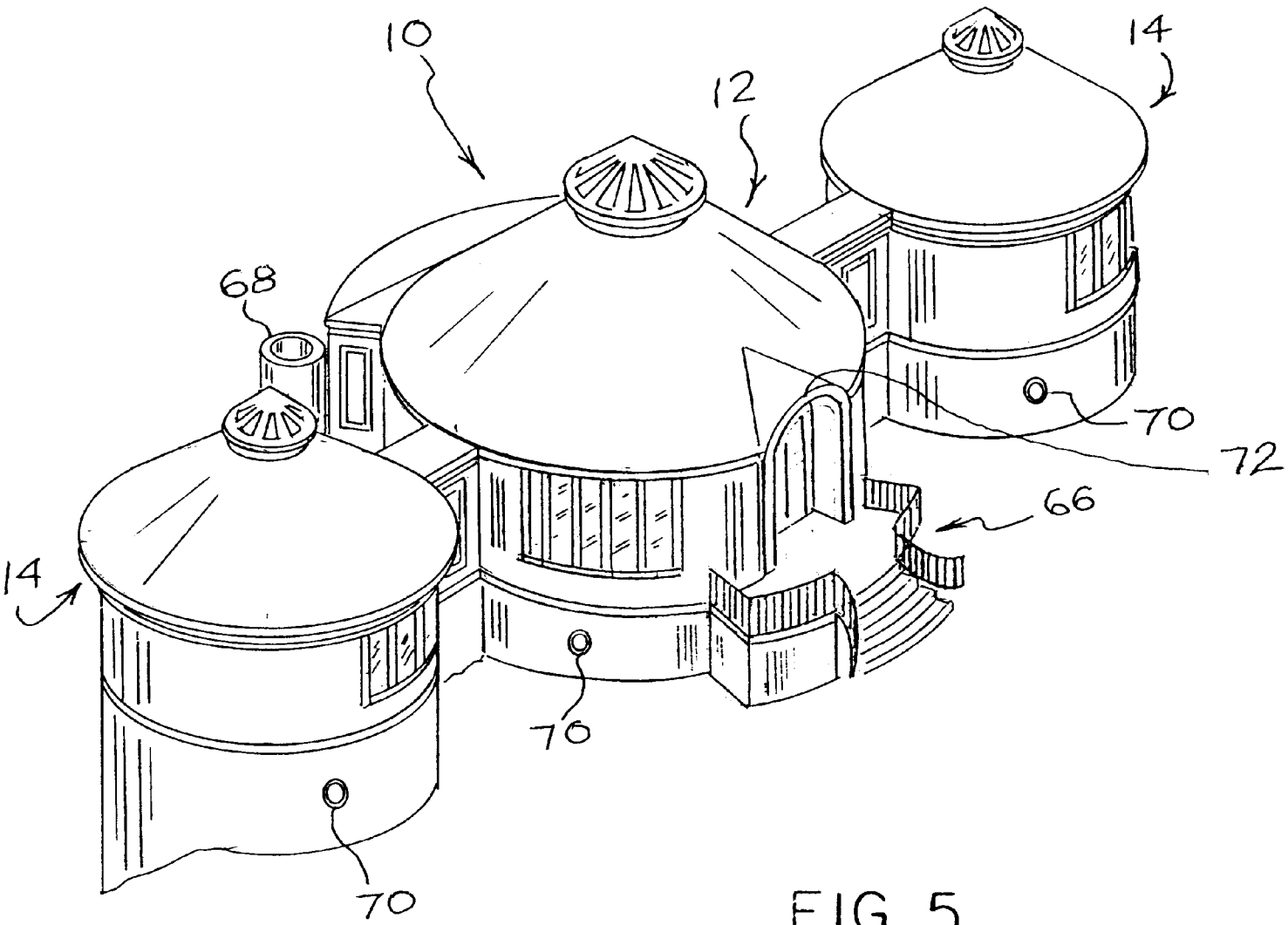
FIG. 5 is a perspective view of the front side of the complex shown in FIGS. 1, 2, 3 and 4.

Referring now to the drawings and particularly to FIG. 5, a residential complex shown generally as 10 is formed from a plurality of circular modules, the principal and largest module 12 housing most of the functional rooms of the Principal module 12 has an outer exterior wall 16 and an interior exterior wall 18, interior wall 18 serving as a working wall for the rooms positioned around the interior periphery of module 12. Module 12 has a living room 20, a dining room 22, a kitchen 24, a breakfast room 26, and a laundry room 28. All of these rooms share module interior perimeter wall 18 as one wall of their respective enclosures. A general sitting area 30 is positioned in the center of module 12 and takes advantage of a skylighting arrangement which will be described in greater detail subsequently. A powder room 29 connects with the living room 20.

A cantilevered arcuate deck and sunroom structure shown generally as 32 extends preferably off the rearward side of module 12 connecting with breakfast room 26 and the kitchen 24 through door 34. The arrangement shown in the floor plan of FIG. 6 has an enclosed sunroom 36 with a connecting deck 38. Structure 32 has a curvature consistent with the curvature of the primary circular module exterior perimeter wall 16 to consistently blend in with the circular design of the entire residence.

Module 12 has an interior perimeter wall engaging stairway 40 connecting the main floor level with the basement and any other additional floors that might be included in the module. Again, circular stairway 40 continues the design theme used throughout the residence of circles and arcuate walls utilizing a design of circle segments.

Secondary modules 14 are positioned as satellites to principal module 12 and preferably house bedrooms and other necessary but more private locations of the residence. The master bedroom 42 has its own separate module that include master bath 44, office or working area 46 and storage locations such as closets 48. This module 14 is connected to principal module 12 by the upper level of a passageway 50 which by its design enables the bedroom and associated areas to be totally isolated from the rest of the residence.

Figure 6:
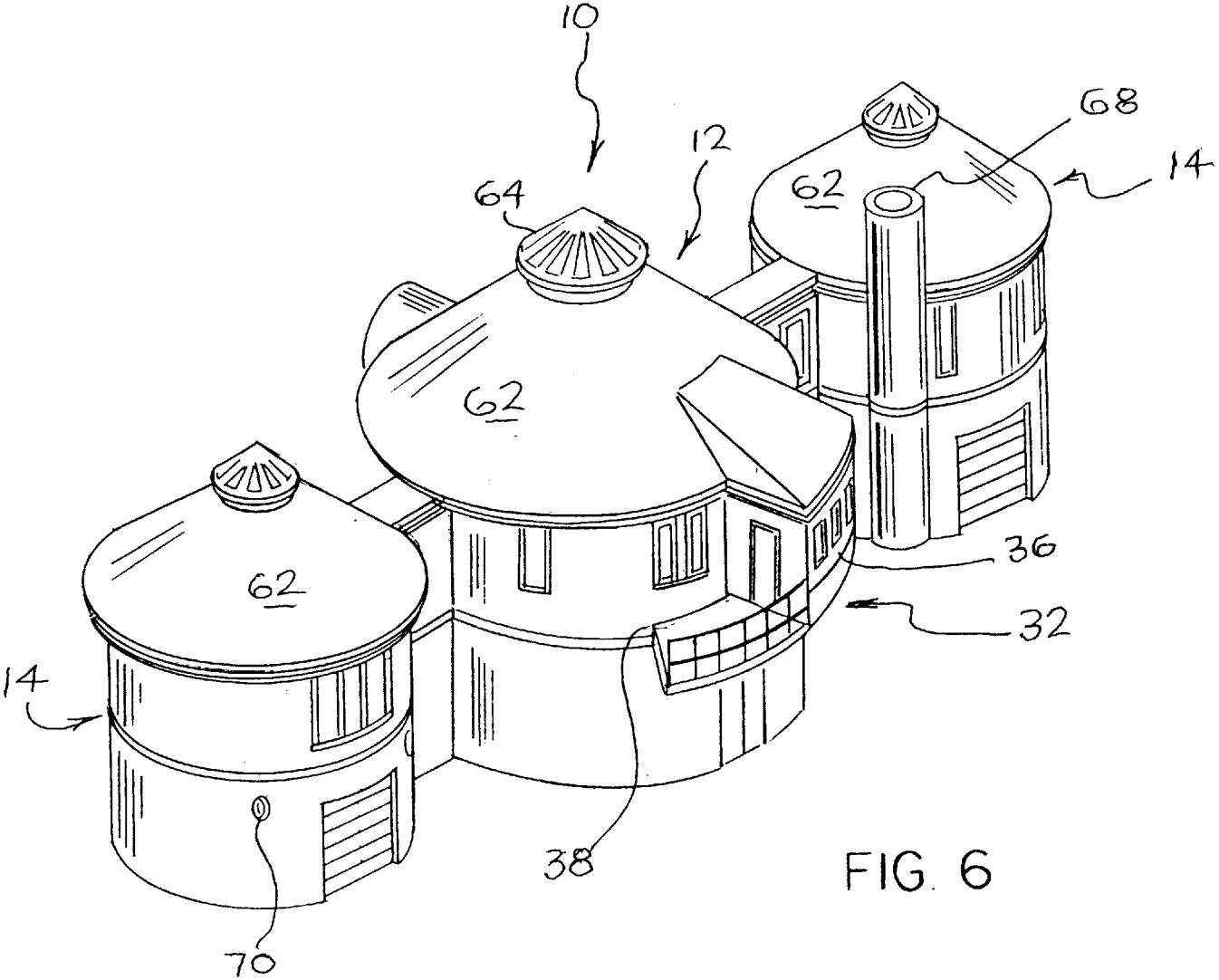
FIG. 6 is a perspective view of the rear side of the building structure shown in FIGS. 1, 2, 3 and 4.
Figure 7:
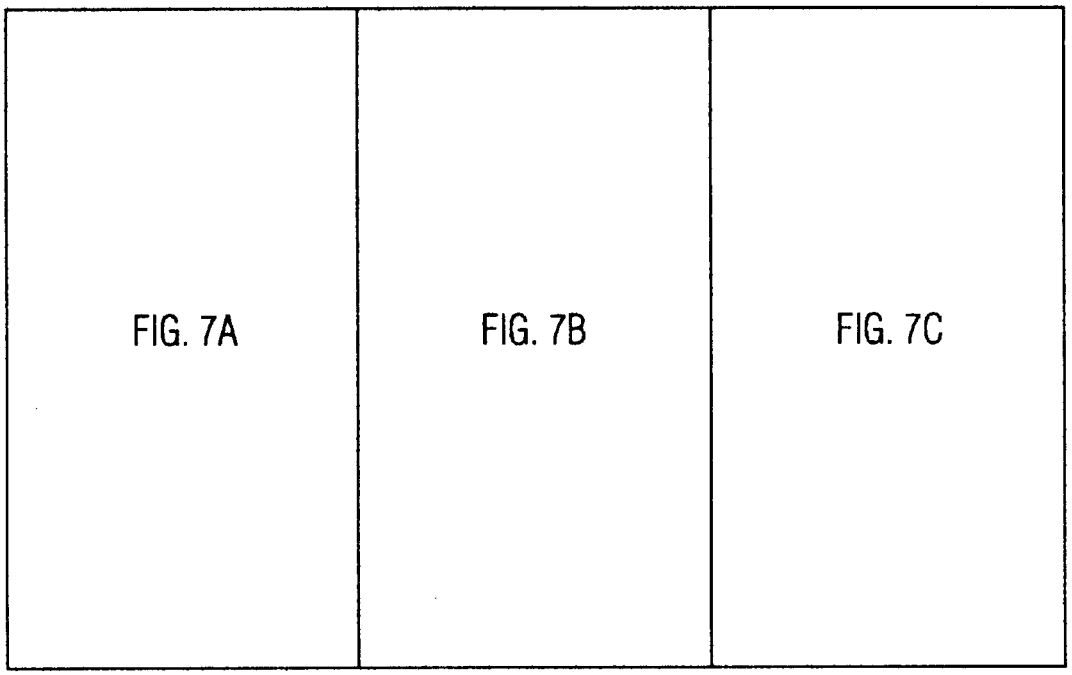
FIG. 7 is a block diagram representing the combined contents of FIGS. 7A, 7B and 7C which together illustrate the entire floor plan of the main floor level of the building structure shown in FIGS. 1–6.
Figure 7A:
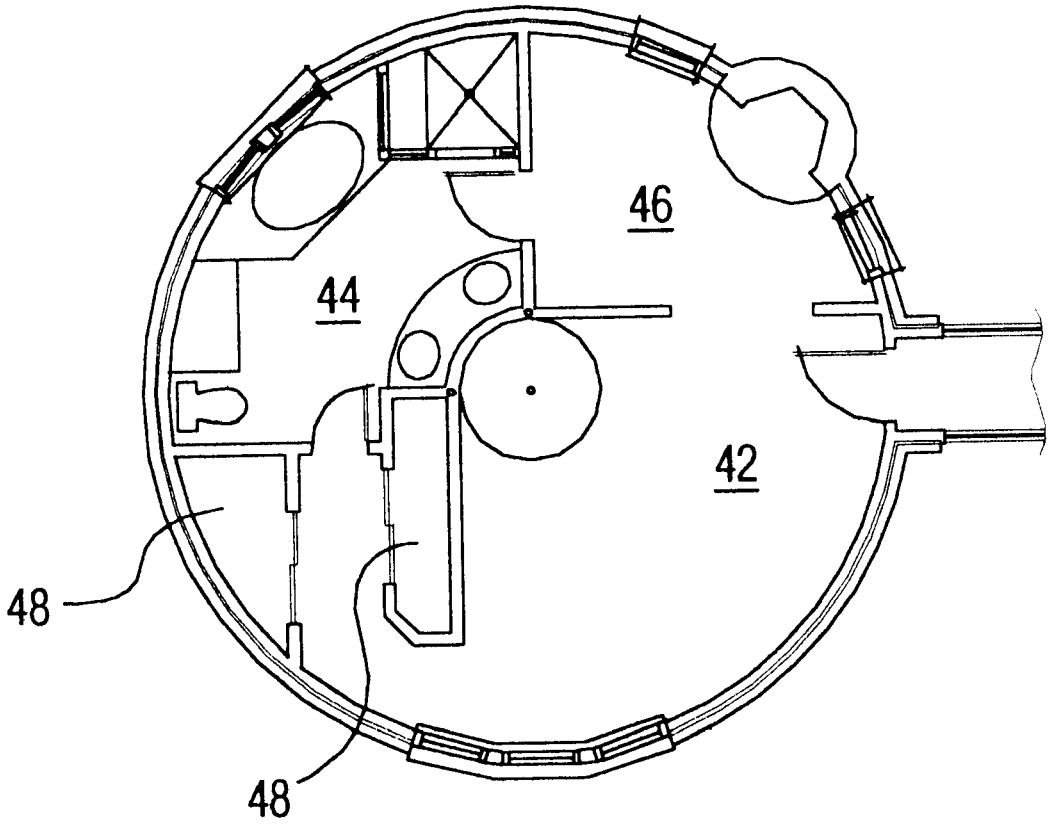
Figure 7B:
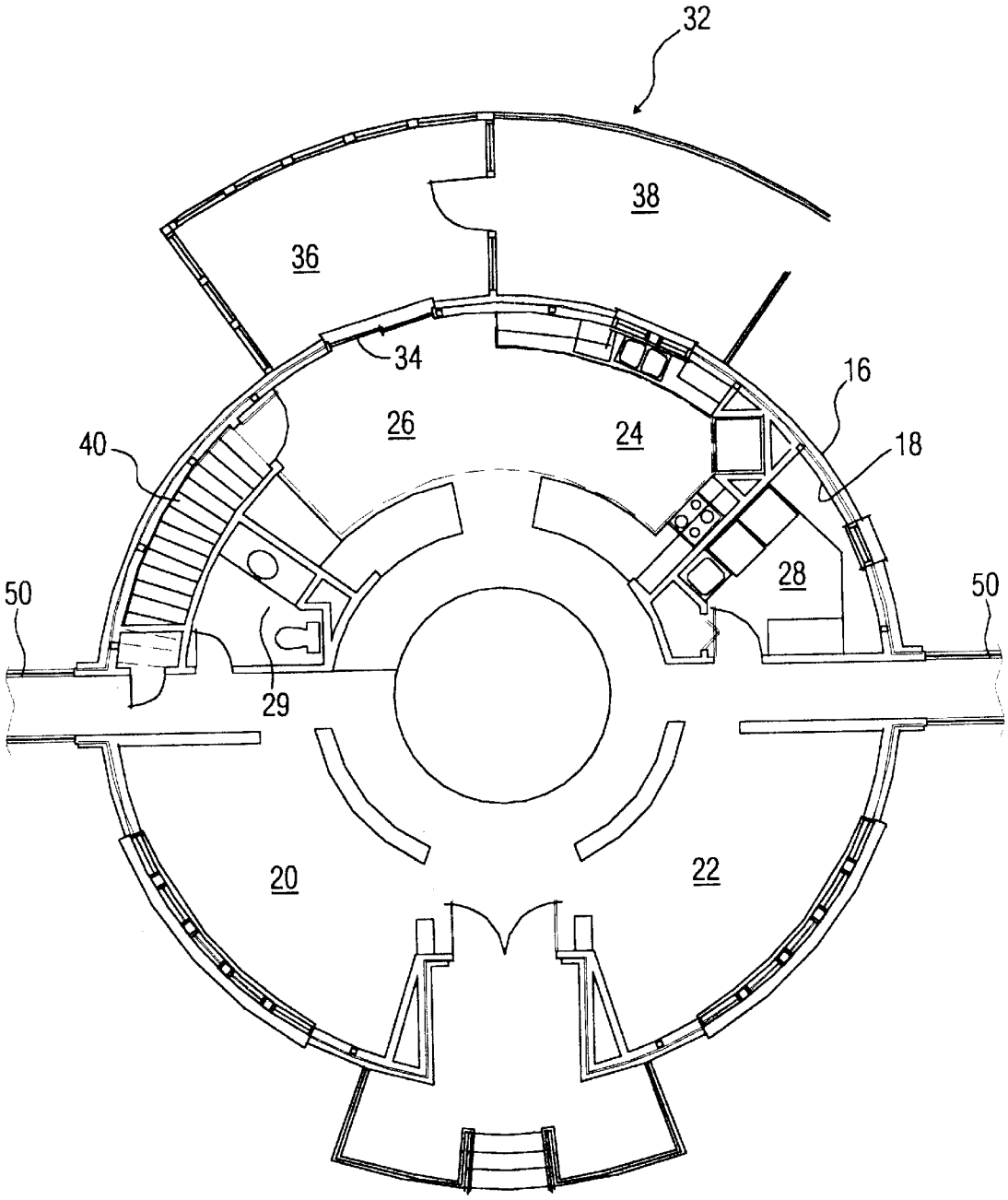
Figure 7C:
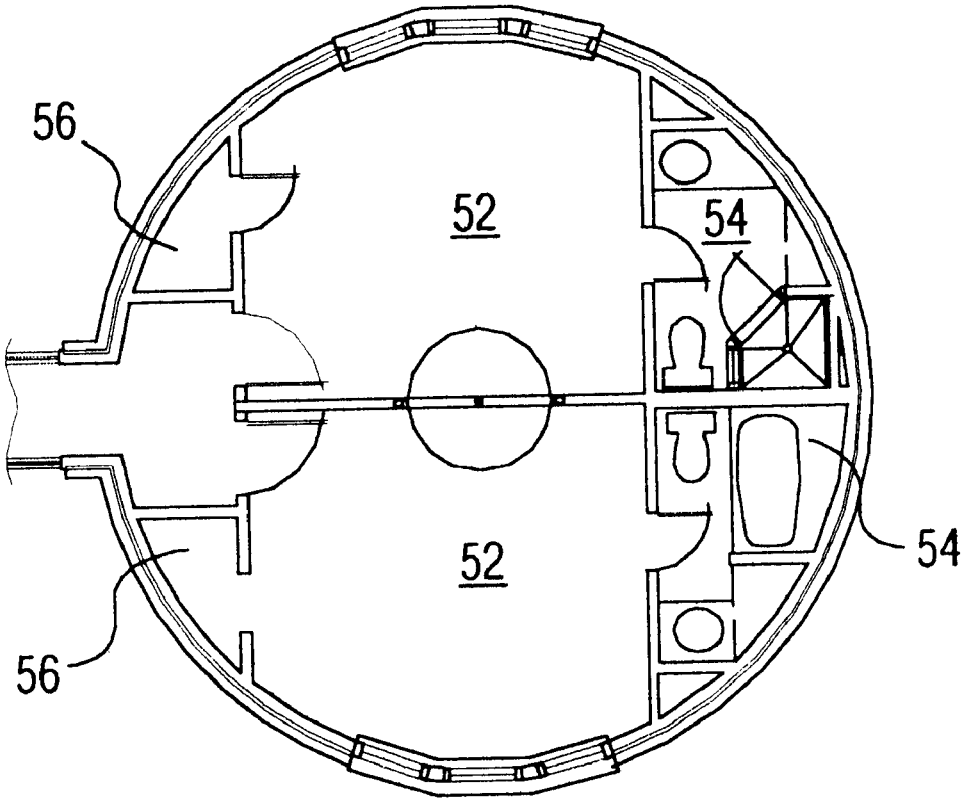

Similarly, one or more additional secondary modules such as that shown in FIG. 6 typically house additional bedrooms 52 with separate baths 54 and storage areas or closets 56. Again this secondary module 14 is capable of being totally isolated from the rest of the residence by closing it off through the main floor level of passageway 50.

Figure 8:
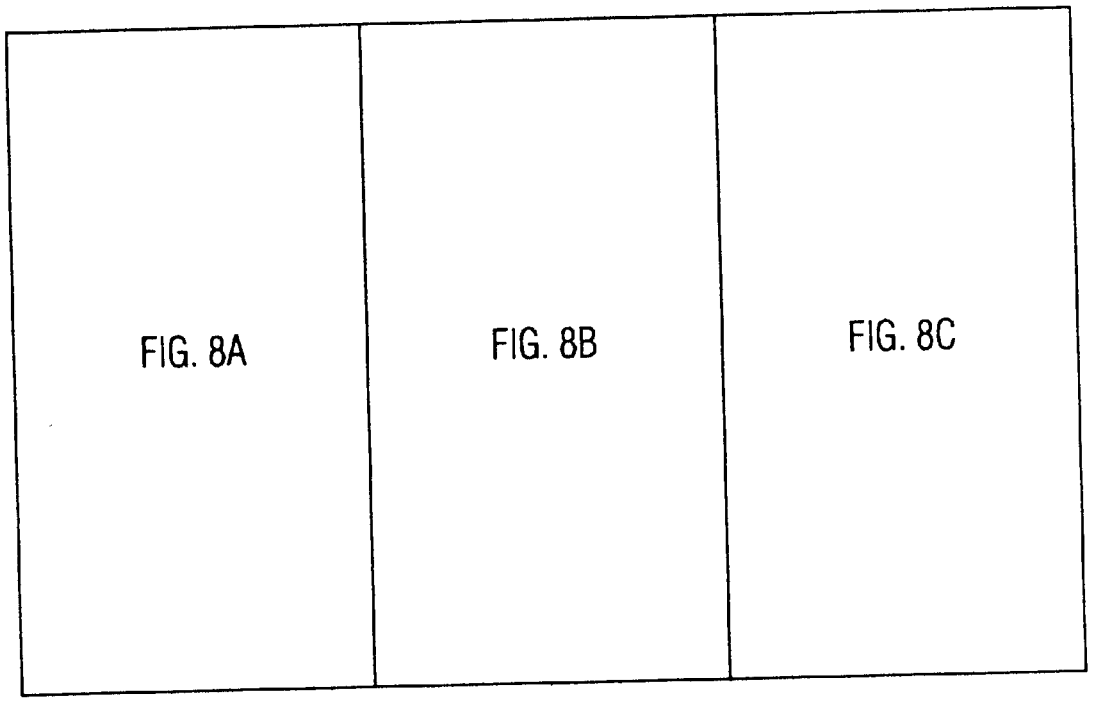
FIG. 8 is a block diamgram representing the combined contents of FIGS. 8A, 8B and 8C which together illustrate the entire plan of the lower or basement floor level of the building structure shown in FIGS. 1–6.
Figure 8A:
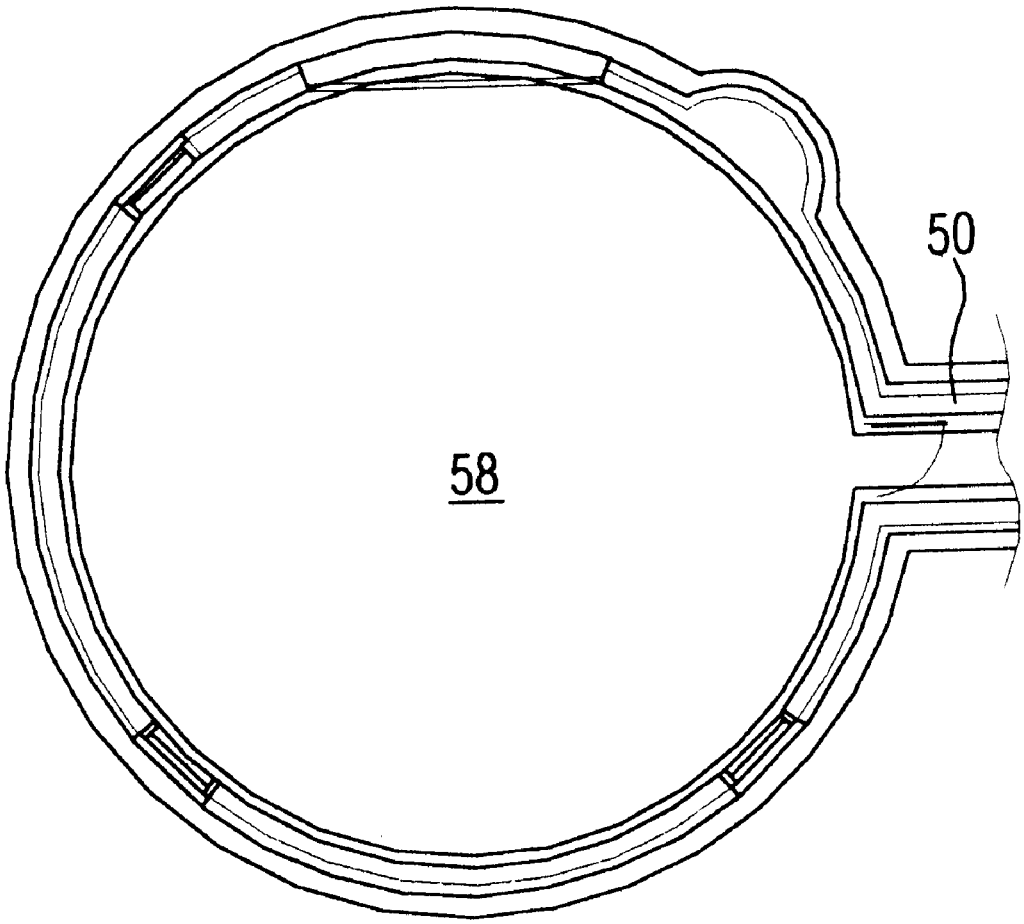
Figure 8B:
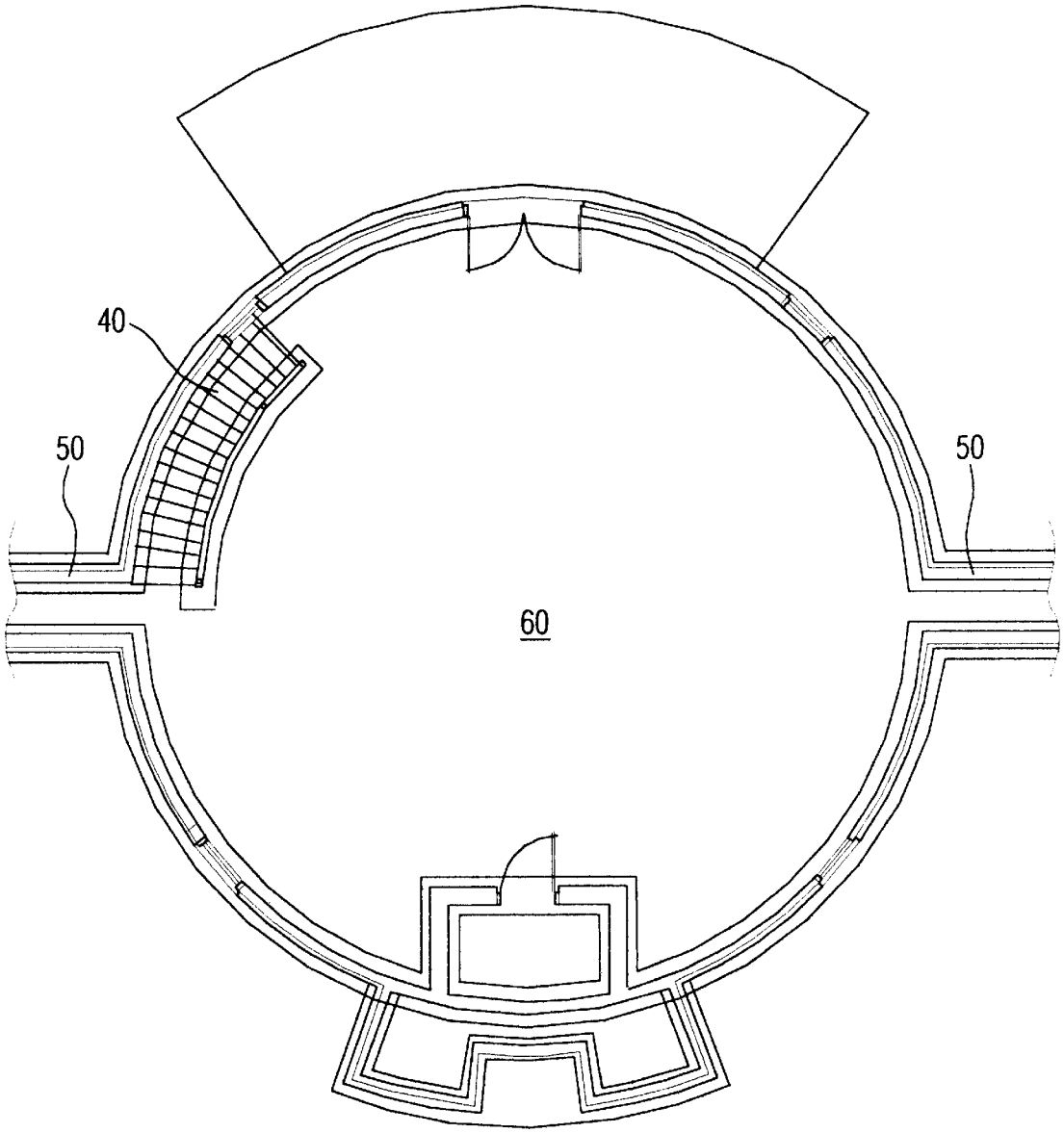
Figure 8C:
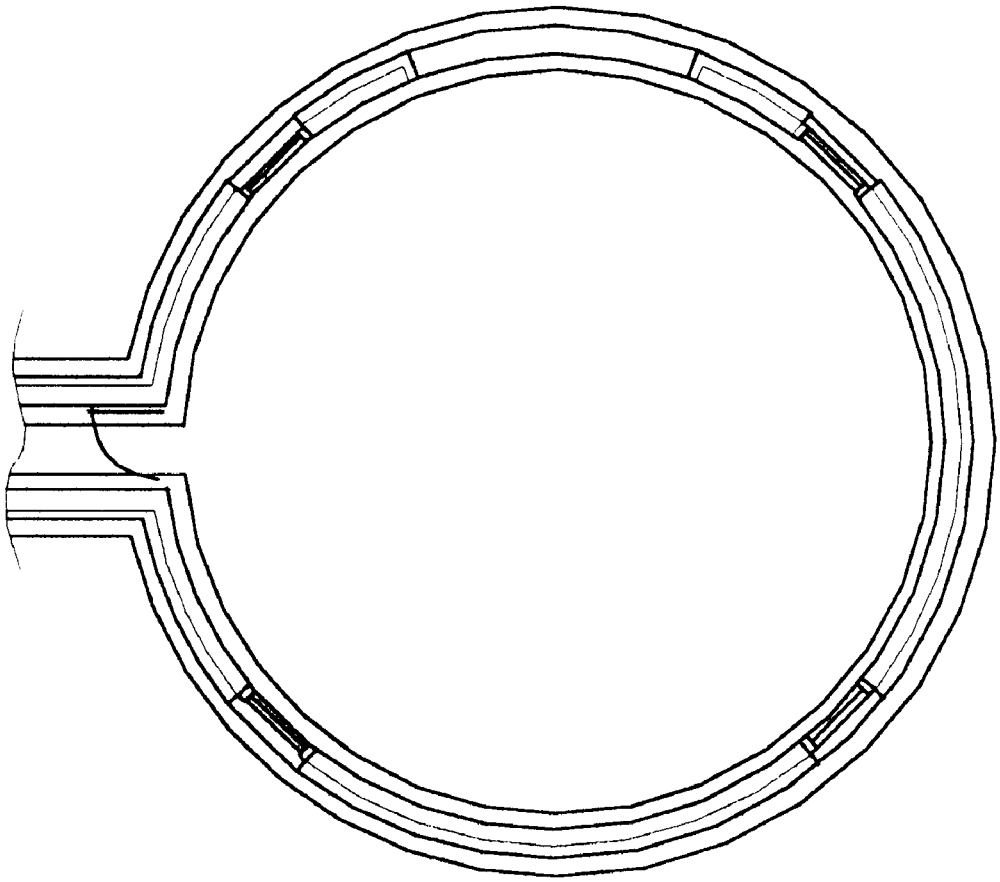

The lower level or basement is shown in FIG. 8 and illustrates the provision of a garage under master bedroom 42 and another garage under each of the other secondary modules 14 that might be included. Primary module 12 has a basement or lower level 60 which connects with the garage through the lower level of passageways 50. The interior perimeter wall stairway 40 provides access from the ground level to the main living level of the residence so that a resident of the dwelling can park in the garage, pass through the lower level of passageway 50 and do up interior perimeter will stairway 40 into the living area of the house.

Consistent with the circular design theme of the house, each module has a circular domed roof 62 and to provide an even and aesthetic appearance and may contain a circular domed skylight 64. The center positioning of the skylights in each of the module enables the even distribution of light from outside modules 12, 14 throughout the interior in a uniform manner.

All of the elements attached to the residence consistently embody the arcuate and circular theme used throughout. For example, the front stoop and porch 66 has a curvature consistent with the curvature of the outer perimeter wall of module 12. In office 46 off master bedroom 42, a fireplace is built into interior and exterior walls 16, 18, and a circular chimney 68 connects with exterior perimeter wall as best shown in FIG. 6. Windows for the ground level are shown as circles 70 to maintain the design theme and arches 72 such as used at the front entrance continue the theme.

The structure of the residence can be very flexible utilizing wood or metals girders where girders are needed. The domed roof construction has significant self support because of its unique design.

It is to be noted that in the preferred embodiment, the interior perimeter wall functions essentially as a straight wall in that there is only a three inch offset in every eight feet of wall length thus enabling the use of conventional furniture within the structure even though the walls are circular. Moreover, the ability to selectively position secondary modules at various isolatable locations around the principal module enables the use of the structure on lots of varying size, elevation and configurations.

Thus an embodiment of the multi-circular module residence comprising the present invention has been illustrated and described in operable form. It is to be realized that optimum dimensional relationships for the parts of the invention to include variations in size, materials, shape, form, function and manner of operation, assembly and use are deemed readily apparent and obvious to one skilled in the art. All equivalent relationships to those illustrated in the drawings and described in the specification are intended to be encompassed herein. The foregoing is considered as illustrative only of the principles of the invention. Numerous modifications and changes will readily occur to those skilled in the art, and it is not desired to limit the invention to the exact construction and operation shown and described. All suitable modifications and equivalents that fall within the scope of the appended claims are deemed within the present inventive concept.

What is claimed is:

1. A multi-circular module residence comprising: a principal circular module having an interior and exterior perimeter wall including a basement and one or more additional floors, each floor having rooms utilizing the interior perimeter wall, a central area and an interior perimeter wall engaging stairway; one or more secondary circular modules with a basement and one or more floors, each floor having one or more rooms; and connecting means connecting the principal circular module with the one or more secondary circular modules.

2. The residence as claimed in claim 1 wherein the one or more secondary circular module is angularly positioned with respect to the principal circular module.

3. The residence as claimed in claim 2 wherein the basements of the principal and secondary circular modules are connected by same level passageways to permit access from the basement of one module to the basement of another module without leaving the residence.

4. The residence as claimed in claim 1 wherein the principal circular module interior perimeter wall engaging stairway connects the basement with the one or more additional floors.

5. The residence as claimed in claim 1 wherein the principal circular module has a cantilevered arcuate structure consistent in curvature with the curvature of the principal circular module exterior perimeter wall.

6. The residence as claimed in claim 1 wherein the basement of the one or more circular modules is a garage having an outside entrance.

7. The residence as claimed in claim 3 wherein the principal circular module interior perimeter wall engaging stairway connects the basement with the one or more additional floors.

8. The residence as claimed in claim 7 wherein the principal circular module has an exterior cantilevered arcuate structure consistent in curvature with the curvature of the principal circular module exterior perimeter wall.

9. The residence as claimed in claim 8 wherein the basement of the one or more secondary circular modules is a garage.

10. The residence as claimed in claim 1 wherein each module has a circular domed roof.

11. The residence as claimed in claim 10 wherein each circular domed roof has a central circular dome skylight.

12. The residence as claimed in claim 1 wherein one or more circular modules has a circular chimney connected to the exterior perimeter wall.

13. The residence as claimed in claim 10 wherein one or more circular modules has a circular chimney connected to the exterior perimeter wall.

14. The residence as claimed in claim 11 wherein one or more circular modules has a circular chimney connected to the exterior perimeter wall.

15. The residence as claimed in claim 9 wherein each module has a circular domed roof.

16. The residence as claimed in claim 15 wherein each circular domed roof has a central circular dome skylight.

17. The residence as claimed in claim 2 wherein the basements of the principal and secondary circular modules are connected by same level passageways to permit access from the basement of one module to the basement of another module without leasing the residence, the principal circular module interior perimeter wall engaging stairway connects the basement with one or more additional floors, the principal circular module has an exterior cantilevered arcuate structure consistent in curvature with the curvature of the principal circular module exterior perimeter wall, the basement of the one or more secondary circular modules is a garage having an outside entrance, each module has a circular domed roof, each circular domed roof has a centered circular dome skylight and one or more circular modules has a circular chimney connecting with the module exterior perimeter wall.

* * * * *